US008366405B2

(12) United States Patent
Miyamura et al.

(10) Patent No.: US 8,366,405 B2
(45) Date of Patent: Feb. 5, 2013

(54) SCREW COMPRESSOR WITH CAPACITY CONTROL SLIDE VALVE

(75) Inventors: Harunori Miyamura, Kent (GB); Mohammod Anwar Hossain, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 241 days.

(21) Appl. No.: 12/808,300

(22) PCT Filed: Dec. 17, 2008

(86) PCT No.: PCT/JP2008/003821

§ 371 (c)(1),
(2), (4) Date: Jun. 15, 2010

(87) PCT Pub. No.: WO2009/078178

PCT Pub. Date: Jun. 25, 2009

(65) Prior Publication Data

US 2010/0260620 A1 Oct. 14, 2010

(30) Foreign Application Priority Data

Dec. 17, 2007 (JP) ..... 2007-324598

(51) Int. Cl.
*F04B 49/00* (2006.01)

(52) U.S. Cl. ..... 417/213; 417/212; 418/195; 418/201.2

(58) Field of Classification Search ..... 417/212, 417/213; 418/195, 201.1, 201.2
See application file for complete search history.

(56) References Cited

U.S. PATENT DOCUMENTS

| | | | | | |
|---|---|---|---|---|---|
| 3,088,658 | A | * | 5/1963 | Wagenius | 418/201.2 |
| 3,874,828 | A | * | 4/1975 | Herschler et al. | 418/87 |
| 4,074,957 | A | * | 2/1978 | Clarke et al. | 418/195 |
| 4,364,714 | A | * | 12/1982 | Zimmern | 417/53 |
| 4,534,719 | A | * | 8/1985 | Zimmern | 418/195 |
| 4,610,613 | A | | 9/1986 | Szymaszek | |
| 5,435,704 | A | * | 7/1995 | Sawyer | 418/201.2 |
| 5,509,273 | A | | 4/1996 | Lakowske et al. | |

FOREIGN PATENT DOCUMENTS

| | | | | |
|---|---|---|---|---|
| CN | 1176680 | A | | 3/1998 |
| JP | 55-096392 | A | | 7/1980 |
| JP | 2-248678 | A | | 10/1990 |
| JP | 7-6509 | B2 | | 1/1995 |
| JP | 7-107390 | B2 | | 11/1995 |
| JP | 2004-316586 | A | | 11/2004 |
| JP | 2005-030361 | A | | 2/2005 |
| JP | 2005030361 | A | * | 2/2005 |

* cited by examiner

*Primary Examiner* — Devon Kramer
*Assistant Examiner* — Joseph Herrmann
(74) *Attorney, Agent, or Firm* — Global IP Counselors

(57) ABSTRACT

A screw compressor includes a casing, a screw rotor disposed in a cylinder portion of the casing to define a compression chamber, and a capacity control slide valve. Fluid sucked into the compression chamber is compressed by rotation of the screw rotor. The slide valve is slidable along a rotation axis of the screw rotor and is opposed to an outer circumferential surface of the screw rotor. The slide valve includes a dynamic pressure generator formed on an opposed surface of the slide valve that is opposed to the screw rotor to generate a dynamic pressure using fluid in contact with the opposed surface of the slide valve. The slide valve is configured so that the dynamic pressure generated by the dynamic pressure generator avoids contact between the slide valve and the screw rotor.

7 Claims, 6 Drawing Sheets

(A)

(B)

SCREW COMPRESSOR WITH CAPACITY CONTROL SLIDE VALVE

CROSS-REFERENCE TO RELATED APPLICATIONS

This U.S. National stage application claims priority under 35 U.S.C. §119(a) to Japanese Patent Application No. 2007-324598, filed in Japan on Dec. 17, 2007, the entire contents of which are hereby incorporated herein by reference.

TECHNICAL FIELD

The present invention relates to measures for increasing the reliability of screw compressors.

BACKGROUND ART

Conventionally, screw compressors have been used as compressors for compressing refrigerant or air. For example, Japanese Patent Publication No. 2004-316586 describes a single screw compressor including one screw rotor and two gate rotors.

The single screw compressor will be described hereinafter. The screw rotor is generally cylindrical in shape, and has a plurality of helical grooves foamed in its outer circumferential surface. The gate rotors are formed in a generally plate-like shape, and are lateral to the screw rotor. The gate rotors each include a plurality of radially arranged gates each having the form of a rectangular plate. The gate rotors are placed in a position where their rotation axes are orthogonal to the rotation axis of the screw rotor. The gates are meshed with the helical grooves of the screw rotor.

The single screw compressor includes the screw rotor and the gate rotors all contained in a casing. The helical grooves of the screw rotor, the gates of the gate rotors, and the inner wall of the casing define a compression chamber. When the screw rotor is rotationally driven by, e.g., an electric motor, the gate rotors rotate with the rotation of the screw rotor. Thus, the gates of the gate rotors relatively move from the beginnings of the helical grooves with which the gates mesh (the end of the suction side of the compressor) to the ends thereof (the end of the discharge side of the compressor). This allows the volume of the completely-closed compression chamber to gradually decrease. As a result, fluid in the compression chamber is compressed.

As described in Japanese Patent Publication Nos. 2004-316586 and 2005-030361, screw compressors include capacity control slide valves. Each of the slide valves is positioned to face the outer circumference of a screw rotor, and is slidable along the rotation axis of the screw rotor. Meanwhile, the screw compressors include bypass paths each formed to provide communication between a compression chamber during a compression phase and the suction side of the compressor. Movement of the slide valve changes the area of the opening of the bypass path in the inner circumferential surface of a cylinder into which the screw rotor is inserted. Thus, the volume of fluid which is returned through the bypass path to the suction side changes. As a result, the volume of compressed fluid which is finally discharged from the compression chamber changes, and thus, the volume of fluid discharged from the screw compressor (i.e., the capacity of the screw compressor) changes.

SUMMARY

Technical Problem

As described above, the slide valve faces a compression chamber defined by a helical groove of the screw rotor. Therefore, in order to reduce the amount of fluid leaking out of the compression chamber to a low level, the gap between the slide valve and the screw rotor is preferably as narrow as possible. However, since, during operation of the screw compressor, various pressures, such as gas pressures, act upon the slide valves, the slide valves may be slightly deformed or slightly move. For this reason, if the gaps between the slide valves and the screw rotor are too narrow, for example, the deformation of the slide valves during operation may cause the slide valves to be in contact with the screw rotor. This may cause a problem, such as seizure. Alternatively, if the gaps between the slide valves and the screw rotor are wide, this increases the amount of fluid leaking out of the compression chamber and decreases the efficiency of the screw compressor while enabling prevention of contact therebetween.

The present invention has been made in view of the foregoing point, and an object thereof is to increase both the efficiency and reliability of a screw compressor by reducing the gap between a slide valve and a screw rotor while preventing contact therebetween.

Solution to the Problem

A first aspect of the invention is directed to a screw compressor including: a casing (10); a screw rotor (40) inserted into a cylinder portion (30) of the casing (10) and defining a compression chamber (23); and a capacity control slide valve (70) being slidable along a rotation axis of the screw rotor (40) and being opposed to an outer circumferential surface of the screw rotor (40), wherein fluid sucked into the compression chamber (23) is compressed by rotation of the screw rotor (40). A dynamic pressure generator (64, 65) is formed on a surface (66) of the slide valve (70) opposed to the screw rotor (40) to generate a dynamic pressure using fluid being in contact with the opposed surface (66), and the slide valve (70) is configured so that the dynamic pressure generated by the dynamic pressure generator avoids contact between the slide valve (70) and the screw rotor (40).

The screw compressor (1) of the first aspect of the invention includes the screw rotor (40) inserted into the cylinder portion (30) of the casing (10), and the compression chamber (23) is defined between the cylinder portion (30) and the screw rotor (40). With rotation of the screw rotor (40), fluid is sucked into the compression chamber (23) and compressed. When the slide valve (70) of the screw compressor (1) is slid, the amount of fluid discharged from the screw compressor (1) per unit time (i.e., the capacity of the screw compressor (1)) changes. The surface of the slide valve (70) opposed to the screw rotor (40) (i.e., the opposed surface (66)) faces the compression chamber (23). Therefore, the surface (66) of the slide valve (70) opposed to the screw rotor (40) is in contact with fluid in the compression chamber (23) moving with rotation of the screw rotor (40).

The dynamic pressure generator (64, 65) is formed on the surface (66) of the slide valve (70) of the first aspect of the invention opposed to the screw rotor (40). The dynamic pressure generator (64, 65) generates a dynamic pressure using the fluid being in contact with the slide valve (70) with rotation of the screw rotor (40). The dynamic pressure generated on the dynamic pressure generator (64, 65) acts on the slide valve (70). This prevents contact between the slide valve (70) and the screw rotor (40).

According to a second aspect of the invention, in the first aspect of the invention, the surface (66) of the slide valve (70) opposed to the screw rotor (40) includes a front step (64) which is formed on part of the opposed surface (66) located forward in a direction of rotation of the screw rotor (40) and which is configured such that a portion of the opposed surface (66) located forward of a side surface of the front step (64) in the direction of rotation of the screw rotor (40) is raised, and the front step (64) serves as the dynamic pressure generator.

The slide valve (70) of the second aspect of the invention includes the front step (64) serving as the dynamic pressure generator. The front step (64) is configured so that a portion of the opposed surface (66) located forward of the side surface of the front step (64) in the direction of rotation of the screw rotor (40) is raised. Therefore, when fluid in the compression chamber (23) moving with rotation of the screw rotor (40) strikes the front step (64), a dynamic pressure is generated. The generated dynamic pressure acts on the slide valve (70). In the slide valve (70), the front step (64) is formed on a portion, located forward in the direction of rotation of the screw rotor (40), of the surface (66) opposed to the screw rotor (40). Therefore, the dynamic pressure generated on the front step (64) acts on the slide valve (70) in the direction in which the portion of the slide valve (70) located forward in the direction of rotation of the screw rotor (40) is separated from the screw rotor (40).

According to a third aspect of the invention, in the second aspect of the invention, in the slide valve (70), a portion, located forward of the side surface of the front step (64) in the direction of rotation of the screw rotor (40), of the surface (66) opposed to the screw rotor (40) is closer to the screw rotor (40) than an inner circumferential surface of the cylinder portion (30).

In the slide valve (70) of the third aspect of the invention, the interval between the screw rotor (40) and the portion of the slide valve (70) located forward in the direction of rotation of the screw rotor (40) is smaller than that between the cylinder portion (30) and the screw rotor (40). Here, the fluid pressure in the compression chamber (23) gradually increases with rotation of the screw rotor (40). Therefore, the gap between the screw rotor (40) and the portion of the slide valve (70) located forward in the direction of rotation of the screw rotor (40) needs to achieve better hermeticity than the gap between the screw rotor (40) and a portion of the slide valve (70) located backward in the direction of rotation of the screw rotor (40). To satisfy this need, the interval between the screw rotor (40) and the portion of the slide valve (70) of the invention located forward in the direction of rotation of the screw rotor (40) is small. This allows the gap between the screw rotor (40) and the portion of the slide valve (70) located forward in the direction of rotation of the screw rotor (40) to achieve relatively good hermeticity.

According to a fourth aspect of the invention, in the second or third aspect of the invention, the surface (66) of the slide valve (70) opposed to the screw rotor (40) includes a back step (65) which is formed on part of the opposed surface (66) located backward in the direction of rotation of the screw rotor (40) and which is configured such that a portion of the opposed surface (66) located forward of a side surface of the back step (65) in the direction of rotation of the screw rotor (40) is raised, and the back step (65) serves as the dynamic pressure generator.

The slide valve (70) of the fourth aspect of the invention includes the back step (65) serving as the dynamic pressure generator. In other words, the slide valve (70) includes both the front and back steps (64, 65) serving as the dynamic pressure generators. A portion of the slide valve (70) located forward of the side surface of the back step (65) in the direction of rotation of the screw rotor (40) is raised. Therefore, when fluid in the compression chamber (23) moving with rotation of the screw rotor (40) strikes the back step (65), a dynamic pressure is generated. The generated dynamic pressure acts on the slide valve (70). In the slide valve (70), the back step (65) is formed on a portion, located backward in the direction of rotation of the screw rotor (40), of the surface (66) opposed to the screw rotor (40). Therefore, the dynamic pressure generated on the back step (65) acts on the slide valve (70) in the direction in which the portion of the slide valve (70) located backward in the direction of rotation of the screw rotor (40) is separated from the screw rotor (40).

According to a fifth aspect of the invention, in the fourth aspect of the invention, in the slide valve (70), a portion, located backward of the side surface of the back step (65) in the direction of rotation of the screw rotor (40), of the surface (66) opposed to the screw rotor (40) is more distant from the screw rotor (40) than the inner circumferential surface of the cylinder portion (30).

In the fifth aspect of the invention, the interval between the screw rotor (40) and the portion of the slide valve (70) located backward in the direction of rotation of the screw rotor (40) is wider than the interval between the cylinder portion (30) and the screw rotor (40). Here, the fluid pressure in the compression chamber (23) gradually increases with rotation of the screw rotor (40). Therefore, fluid is less likely to leak out of the gap between the screw rotor (40) and the portion of the slide valve (70) located backward in the direction of rotation of the screw rotor (40) than to leak out of the gap between the screw rotor (40) and the portion of the slide valve (70) located forward in the direction of rotation of the screw rotor (40). In view of the above, even when the interval between the screw rotor (40) and the portion of the slide valve (70) located backward in the direction of rotation of the screw rotor (40) is increased, the amount of fluid leaking out of the gap between the slide valve (70) and the screw rotor (40) hardly increases.

Advantages of the Invention

According to the present invention, the surface (66) of the slide valve (70) opposed to the screw rotor (40) includes the dynamic pressure generator (64, 65), and the dynamic pressure generator (64, 65) generates a dynamic pressure using fluid flowing in the compression chamber (23) while being in contact with the slide valve (70). The slide valve (70) is maintained without being in contact with the screw rotor (40) by the dynamic pressure generated on the dynamic pressure generator (64, 65). In view of the above, even if, for example, deformation of the slide valve (70) during operation of the screw compressor (1) causes the slide valve (70) to move closer to the screw rotor (40), the slide valve (70) is maintained without being in contact with the screw rotor (40) because the dynamic pressure generated on the dynamic pressure generator (64, 65) acts on the slide valve (70). Thus, according to the present invention, even when such a wide clearance is not provided between the slide valve (70) and the screw rotor (40), contact between the slide valve (70) and the screw rotor (40) during operation of the screw compressor (1) can be avoided. This can increase both the reliability and efficiency of the screw compressor (1).

According to the second aspect of the invention, the front step (64) having a simple shape is formed on the slide valve (70), and serves as the dynamic pressure generator. This allows the structure of the slide valve (70) to be less complicated, and simultaneously enables generation of a dynamic pressure using fluid being in contact with the slide valve (70). In the slide valve (70) of the invention, the front step (64) is formed on a portion, located forward in the direction of rotation of the screw rotor (40), of the surface (66) opposed to the screw rotor (40). This enables action of a dynamic pressure on a portion of the slide valve (70) tending to be in contact with the screw rotor (40), and can reliably prevent contact between the slide valve (70) and the screw rotor (40).

According to the third aspect of the invention, the portion of the slide valve (70) located forward of the side surface of the front step (64) in the direction of rotation of the screw rotor (40) protrudes inwardly beyond the inner circumferential surface of the cylinder portion (30). This can improve the hermeticity of the gap between the screw rotor (40) and the portion of the slide valve (70) located forward in the direction of rotation of the screw rotor (40) by utilizing the front step (64) for generating a dynamic pressure. In view of the above, according to the invention, while contact between the slide valve (70) and the screw rotor (40) can be avoided by utilizing the dynamic pressure generated on the front step (64), the efficiency of the screw compressor (1) can be improved by reducing the amount of refrigerant leaking out of the compression chamber (23) through the gap between the slide valve (70) and the screw rotor (40).

According to the fourth aspect of the invention, the slide valve (70) includes the front and back steps (64, 65) serving as the dynamic pressure generators. As described above, the dynamic pressure generated on the front step (64) acts on the slide valve (70) in the direction in which the portion of the slide valve (70) located forward in the direction of rotation of the screw rotor (40) is separated from the screw rotor (40). Therefore, when the dynamic pressure generated on the front step (64) is too high, the portion of the slide valve (70) located backward in the direction of rotation of the screw rotor (40) may be in contact with the screw rotor (40). In contrast, the dynamic pressure generated on the back step (65) acts on the slide valve (70) in the direction in which the portion of the slide valve (70) located backward in the direction of rotation of the screw rotor (40) is separated from the screw rotor (40). In view of the above, according to the invention, the balance achieved between the dynamic pressure generated on the front step (64) and the dynamic pressure generated on the back step (65) can reliably maintain the slide valve (70) while the slide valve (70) is not in contact with the screw rotor (40).

BRIEF DESCRIPTION OF THE DRAWINGS

FIG. 6 is a schematic enlarged cross-sectional view illustrating portions of the single screw compressor, in which FIG. 6(A) illustrates the position of the slide valve where part of the slide valve located forward in the direction of rotation of a screw rotor is close to the screw rotor, and FIG. 6(B) illustrates the position of the slide valve where part of the slide valve located backward in the direction of rotation of the screw rotor is close to the screw rotor.

FIG. 7 is a plan view illustrating operation of a compression mechanism of the single screw compressor, in which FIG. 7(A) illustrates a suction phase of the compressor, FIG. 7(B) illustrates a compression phase thereof, and FIG. 7(C) illustrates a discharge phase thereof.

DESCRIPTION OF EMBODIMENTS

An embodiment of the present invention will be described in detail hereinafter with reference to the drawings.

A single screw compressor (1) (hereinafter simply referred to as the screw compressor) of this embodiment is provided in a refrigerant circuit operating in a refrigeration cycle to compress refrigerant.

Figure 1:
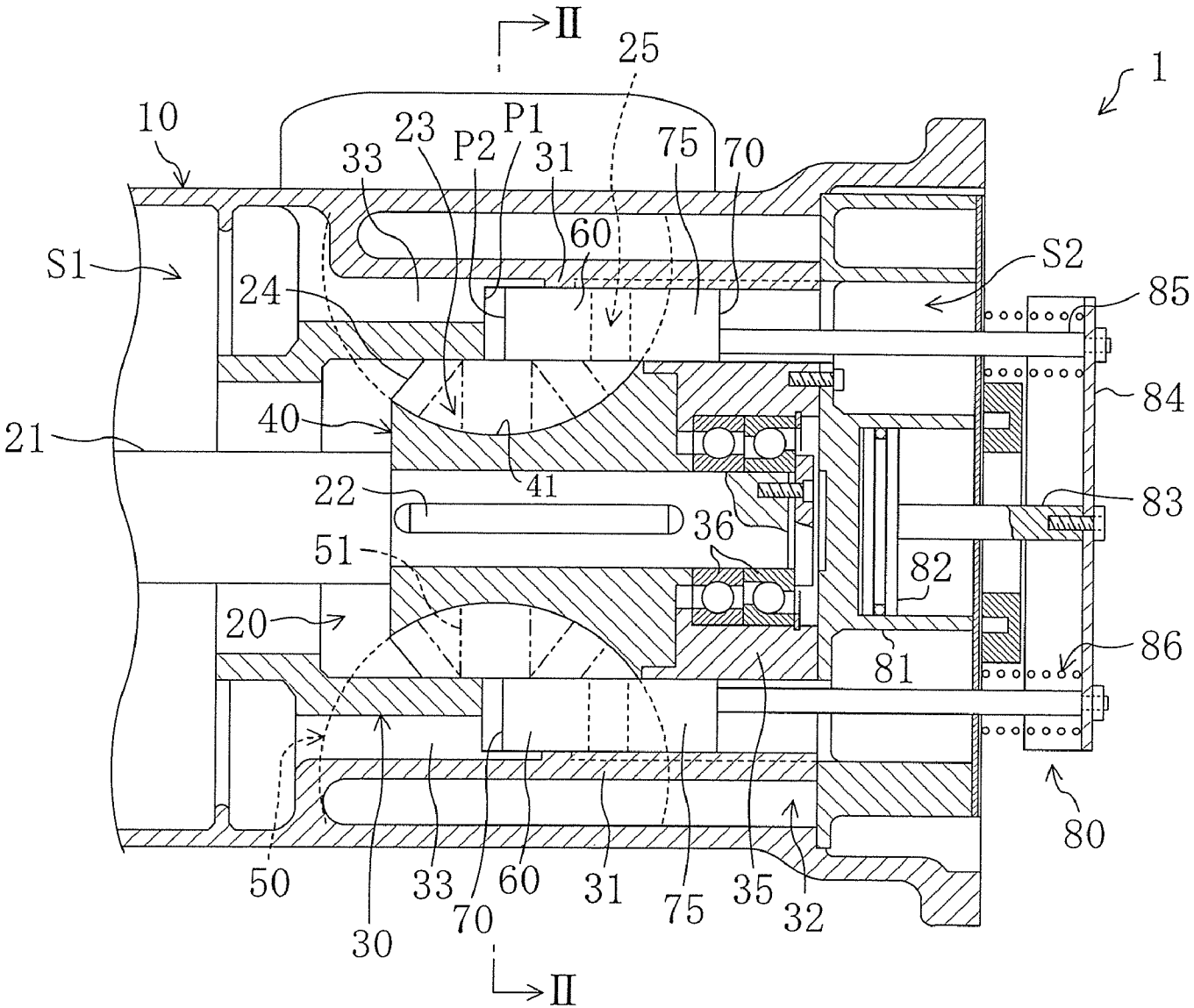
FIG. 1 is a longitudinal cross-sectional view illustrating the structure of a single screw compressor having a capacity control slide valve in accordance with an embodiment of the present invention.
Figure 2:
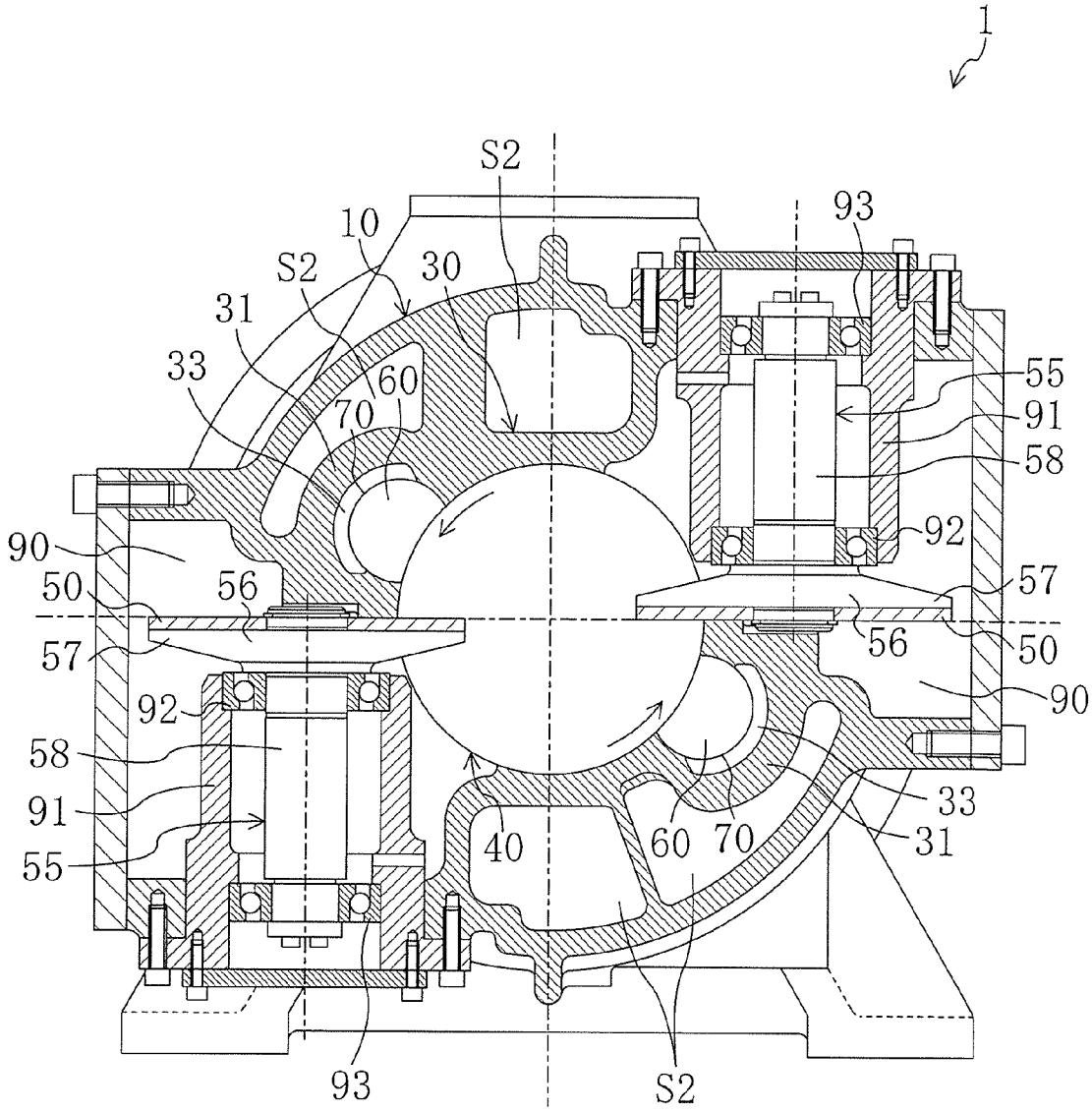
FIG. 2 is a cross-sectional view taken along the line II-II in FIG. 1.

As illustrated in FIGS. 1 and 2, the screw compressor (1) is a semi-hermetic compressor. The screw compressor (1) includes a compression mechanism (20) and an electric motor for driving the compression mechanism (20). The compression mechanism (20) and the electric motor are contained in one casing (10). The compression mechanism (20) is coupled to the electric motor through a drive shaft (21). In FIG. 1, the electric motor is not illustrated. The interior of the casing (10) is sectioned into the following spaces: a low-pressure space (S1) into which low-pressure refrigerant gas is introduced from an evaporator of a refrigerant circuit and through which the low-pressure gas is guided to the compression mechanism (20); and a high-pressure space (S2) into which high-pressure refrigerant gas discharged from the compression mechanism (20) flows.

The compression mechanism (20) includes a cylindrical wall (30) formed in the casing (10), one screw rotor (40) disposed inside the cylindrical wall (30), and two gate rotors (50) meshing with the screw rotor (40). The cylindrical wall (30) forms a cylinder portion of the casing (10). The drive shaft (21) is inserted through the screw rotor (40). The screw rotor (40) and the drive shaft (21) are coupled together via a key (22). The drive shaft (21) is disposed coaxially with the screw rotor (40). A distal end portion of the drive shaft (21) is rotatably supported by a bearing holder (35) located toward the high-pressure side of the compression mechanism (20) (toward the right side of the drive shaft (21) when the axial directions of the drive shaft (21) in FIG. 1 correspond to the right and left). The bearing holder (35) supports the drive shaft (21) through ball bearings (36).

Figure 3:
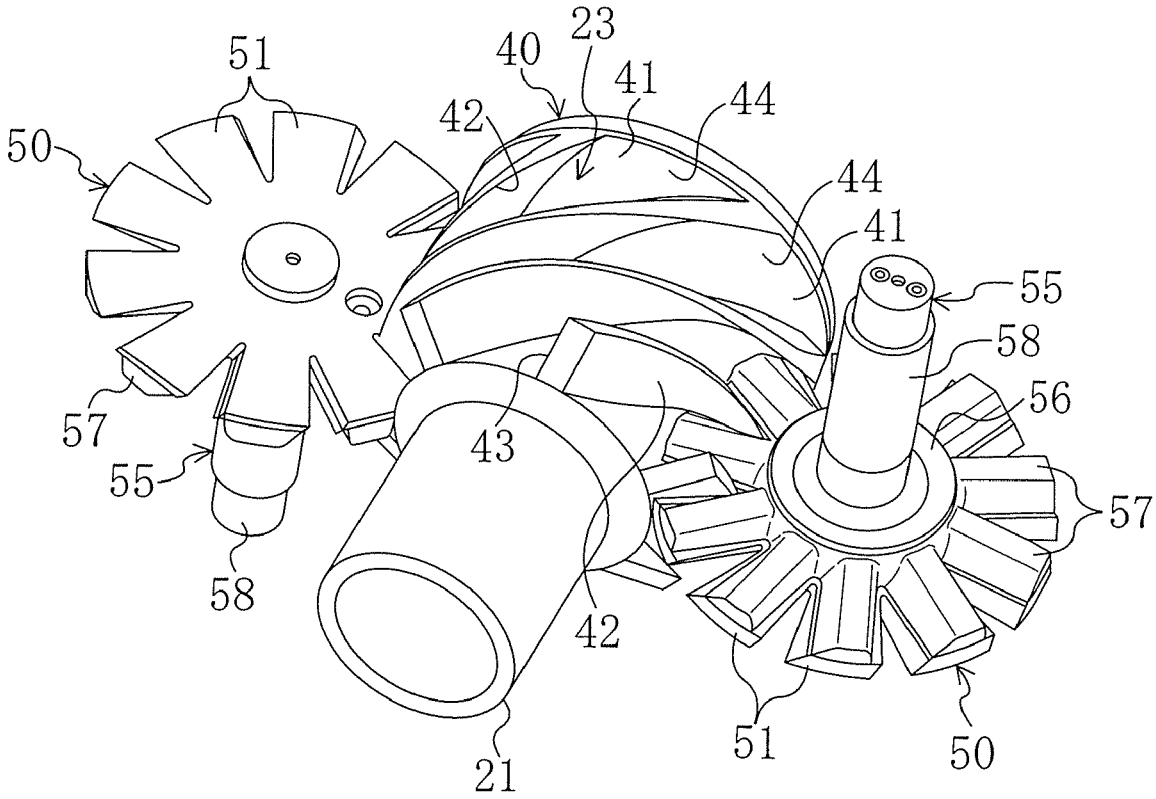
FIG. 3 is a perspective view illustrating parts of the single screw compressor separated from the casing of the single screw compressor.

As illustrated in FIG. 3, the screw rotor (40) is a metal member formed in a generally cylindrical shape. The screw rotor (40) is rotatably fitted to the cylindrical wall (30). The outer circumferential surface of the screw rotor (40) is in slidable contact with the inner circumferential surface of the cylindrical wall (30). A plurality of (in this embodiment, six) helical grooves (41) are formed in the outer circumferential surface of the screw rotor (40) to helically extend from one end of the screw rotor (40) to the other end thereof.

The front end of each of the helical grooves (41) of the screw rotor (40) in FIG. 3 corresponds to the beginning of the helical groove (41), and the back end of the helical groove (41) in FIG. 3 corresponds to the end of the helical groove (41). Front end part of the screw rotor (40) (end part thereof located toward the suction side) in FIG. 3 is tapered. The tapered front end part of the screw rotor (40) illustrated in FIG. 3 has a front end surface in which the beginnings of the helical grooves (41) are formed, while the ends of the helical grooves (41) are not formed in the back end surface of the screw rotor (40).

The gate rotors (50) are resin members. The gate rotors (50) each include a plurality of (in this embodiment, eleven) radially arranged gates (51) each having the shape of a rectangular plate. The gate rotors (50) are disposed outside the cylindrical wall (30) axisymmetrically about the rotation axis of the screw rotor (40). Specifically, in the screw compressor (1)

of this embodiment, the two gate rotors (50) are disposed about the central axis of rotation of the screw rotor (40) at equal angular intervals (in this embodiment, 180-degree intervals). The axes of the gate rotors (50) are orthogonal to the axis of the screw rotor (40). The gate rotors (50) are disposed such that some of the gates (51) pass through the cylindrical wall (30) and mesh with the corresponding helical grooves (41) of the screw rotor (40).

The gate rotors (50) are fitted to rotor supports (55) made of metal (see FIG. 3). The rotor supports (55) each include a base (56), arms (57), and a shaft (58). The base (56) is formed in a slightly thicker disc-like shape. The number of the arms (57) is identical with that of the gates (51) of each of the gate rotors (50). The arms (57) extend radially outwardly from the outer circumferential surface of the base (56). The shaft (58) is formed in a rod-like shape, and is placed upright on the base (56). The central axis of the shaft (58) coincides with the central axis of the base (56). Each of the gate rotors (50) is fitted to the face of a combination of the base (56) and the arms (57) opposite to the shaft (58). The arms (57) abut against the back faces of the gates (51).

The rotor supports (55) to which the gate rotors (50) are fitted are contained in corresponding gate rotor chambers (90) which are adjacent to the cylindrical wall (30) and into which the interior of the casing (10) is sectioned (see FIG. 2). The rotor support (55) located to the right of the screw rotor (40) in FIG. 2 is placed such that the corresponding gate rotor (50) is located toward the lower end of the rotor support (55). On the other hand, the rotor support (55) located to the left of the screw rotor (40) in FIG. 2 is placed such that the corresponding gate rotor (50) is located toward the upper end of the rotor support (55). The shaft (58) of each of the rotor supports (55) is rotatably supported through ball bearings (92, 93) by a bearing housing (91) in the corresponding gate rotor chamber (90). The gate rotor chambers (90) communicate with the low-pressure space (S1).

In the compression mechanism (20), a space surrounded by the inner circumferential surface of the cylindrical wall (30), one of the helical grooves (41) of the screw rotor (40), and the corresponding gate (51) of one of the gate rotors (50) forms a compression chamber (23). A suction-side end portion of the helical groove (41) of the screw rotor (40) is open to the low-pressure space (S1). The open portion of the screw rotor (40) functions as a suction port (24) of the compression mechanism (20).

The screw compressor (1) includes capacity control slide valves (70). The slide valves (70) are provided in slide valve containers (31) configured so that two portions of the cylindrical wall (30) which are arranged in the circumferential direction protrude radially outwardly. The slide valves (70) are slidable along the axis of the cylindrical wall (30), and face the circumferential side surface of the screw rotor (40) while being inserted into the slide valve containers (31). The detailed structure of each of the slide valves (70) will be described below.

When each of the slide valves (70) is slid toward the high-pressure space (S2) (toward the right side of the drive shaft (21) when the axial directions of the drive shaft (21) in FIG. 1 correspond to the right and left), an axial gap is formed between an end surface (P1) of the corresponding slide valve container (31) and an end surface (P2) of the slide valve (70). The axial gap functions as part of a bypass path (33) for returning refrigerant from the compression chamber (23) into the low-pressure space (S1). One end of the bypass path (33) communicates with the low-pressure space (S1). The other end of the bypass path (33) can be formed in the inner circumferential surface of the cylindrical wall (30). When the degree of opening of the bypass path (33) is changed by moving the slide valve (70), the capacity of the compression mechanism (20) varies. A discharge port (25) is formed in the slide valve (70) to allow the compression chamber (23) to communicate with the high-pressure space (S2).

The screw compressor (1) includes a slide valve drive mechanism (80) for slidably driving the slide valves (70). The slide valve drive mechanism (80) includes a cylinder (81) fixed to the bearing holder (35), a piston (82) inserted into the cylinder (81), an arm (84) coupled to a piston rod (83) of the piston (82), connecting rods (85) connecting the arm (84) to the slide valves (70), and springs (86) for biasing the arm (84) to the right in FIG. 1 (in the direction in which the arm (84) is separated from the casing (10)).

In the slide valve drive mechanism (80) illustrated in FIG. 1, the inner pressure of a space located to the left of the piston (82) (a space extending from the piston (82) to the screw rotor (40)) is higher than that of a space located to the right of the piston (82) (a space extending from the piston (82) to the arm (84)). The slide valve drive mechanism (80) adjusts the locations of the slide valves (70) by adjusting the inner pressure of the space located to the right of the piston (82) (i.e., the gas pressure in the space located to the right of the piston (82)).

During operation of the screw compressor (1), the suction pressure of the compression mechanism (20) acts on one of the axial end surfaces of each of the slide valves (70), and the discharge pressure thereof acts on the other axial end surface of the slide valve (70). Therefore, during operation of the screw compressor (1), a force constantly acts on the slide valve (70) in the direction in which the slide valve (70) is pushed toward the low-pressure space (Si). In view of the above, when the inner pressure of the space located in the slide valve drive mechanism (80) and to the left of the piston (82) and the inner pressure of the space located therein and to the right of the piston (82) are changed, this allows change in the magnitude of the force acting in the direction in which the slide valve (70) is returned into the high-pressure space (S2). Consequently, the location of the slide valve (70) varies.

Figure 4:
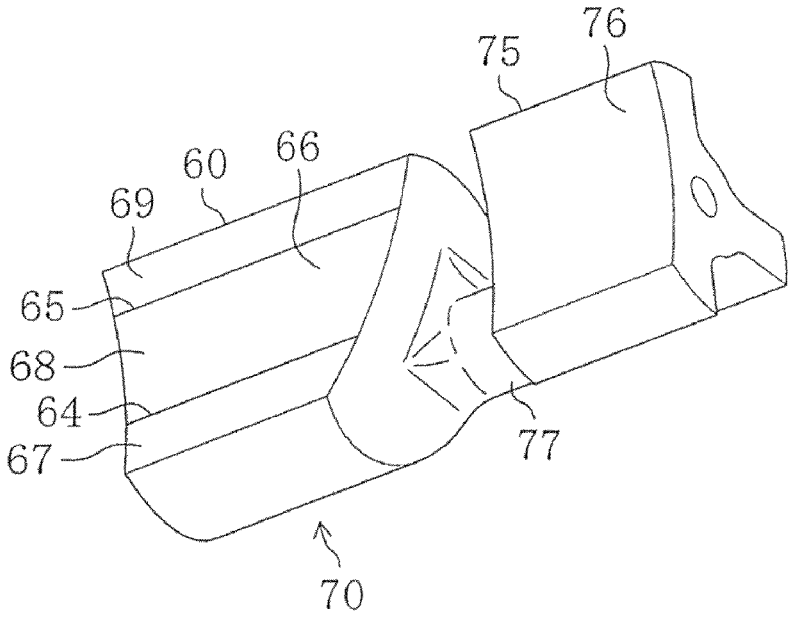
FIG. 4 is a perspective view of the capacity control slide valve of the screw compressor.

The detailed structure of each of the slide valves (70) will be described. As illustrated in FIG. 4, the slide valve (70) includes a valve body (60), a guide portion (75), and a coupling portion (77). In the slide valve (70), a main body (61) of the valve body (60), the guide portion (75), and the coupling portion (77) form one metal member. In other words, the main body (61) of the valve body (60), the guide portion (75), and the coupling portion (77) are integrally formed.

As illustrated also in FIG. 2, the valve body (60) is shaped such that part of a solid cylinder is removed, and is placed in the casing (10) in a position where the surface of the valve body (60) exposed by removing the part of the solid cylinder faces the screw rotor (40). The surface (66) of the valve body (60) opposed to the screw rotor (40) forms an arc-shaped surface having a curvature radius substantially equal to that of the inner circumferential surface of the cylindrical wall (30), and extends along the axis of the valve body (60). One end surface of the valve body (60) forms a flat surface orthogonal to the axis of the valve body (60), and the other end surface thereof forms an inclined surface which is inclined relative to the axis of the valve body (60). The inclination of the other end surface of the valve body (60) forming the inclined surface is identical with that of each of the helical grooves (41) of the screw rotor (40).

The guide portion (75) has a cross section formed in a T-shaped columnar shape. The side surface of the guide portion (75) corresponding to the crossbar of the T-shaped columnar shape (i.e., the side surface thereof facing frontward in FIG. 4) forms an arc-shaped surface having a curvature radius substantially equal to that of the inner circumferential surface of the cylindrical wall (30), and functions as a sliding surface (76) being in slidable contact with the outer circumferential surface of the bearing holder (35). The guide portion (75) of the slide valve (70) is disposed apart from the end surface of the valve body (60) forming an inclined surface in a position where the sliding surface (76) is oriented along the direction in which the opposed surface (66) is oriented.

The coupling portion (77) is formed in a relatively short columnar shape, and couples the valve body (60) and the guide portion (75) together. The coupling portion (77) is offset toward the side of the valve body (60) or the guide portion (75) opposite to the opposed surface (66) of the valve body (60) or the sliding surface (76) of the guide portion (75). A space between the valve body (60) of the slide valve (70) and the guide portion (75) thereof and a space located to the back of the guide portion (75) (i.e., a space extending from the guide portion (75) in the direction opposite to the sliding surface (76)) form a path for discharge gas. A space between the opposed surface (66) of the valve body (60) and the sliding surface (76) of the guide portion (75) forms the discharge port (25).

The opposed surface (66) of the valve body (60) includes a front step (64) and a back step (65). The front step (64) and the back step (65) both extend along the axis of the valve body (60), and form dynamic pressure generators.

Figure 5:
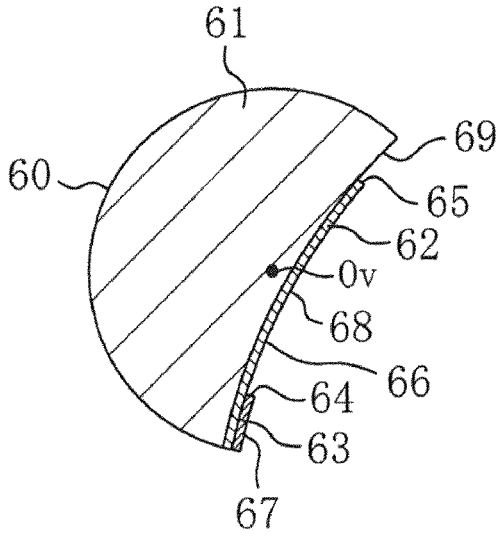
FIG. 5 is a schematic cross-sectional view of a valve body of the slide valve.

As illustrated in FIG. 5, the valve body (60) includes the main body (61) made of metal, and resin coatings (62, 63) formed on a surface of the main body (61). The valve body (60) has the two steps (64, 65) formed using the coatings (62, 63). The coatings (62, 63) of the valve body (60) cover part of the surface of the main body (61) facing the screw rotor (40).

Specifically, a first coating (62) covers a region of the surface of the main body (61) facing the screw rotor (40), and the region thereof extends from the lower end of the main body (61) in FIG. 5 to slightly below the upper end thereof in FIG. 5. In other words, a region of the surface of the main body (61) facing the screw rotor (40) is exposed along the upper end of the main body (61) in FIG. 5, and the exposed region has a predetermined width. The other region of the surface of the main body (61) facing the screw rotor (40) is covered with the first coating (62). The first coating (62) has a thickness of, e.g., approximately 5 μm. Upper end part of the first coating (62) of the valve body (60) in FIG. 5 corresponds to the back step (65).

As illustrated in FIG. 5, a second coating (63) is formed on the first coating (62) of the valve body (60). The second coating (63) covers a region of the surface of the first coating (62) of the valve body (60), and the region thereof extends from the lower end of the main body (61) in FIG. 5 and has a predetermined width. In other words, a region of the surface of the first coating (62) is covered with the second coating (63), and the region thereof extends along the lower end of the valve body (60) in FIG. 5 and has a predetermined width. The second coating (63) has a thickness of e.g., approximately 5 μm. Upper end part of the second coating (63) of the valve body (60) in FIG. 5 corresponds to the front step (64).

As described above, the first coating (62) and the second coating (63) are formed on the surface of the main body (61) of the valve body (60). The opposed surface (66) of the valve body (60) includes a portion of the surface of the main body (61), a portion of the surface of the first coating (62), and the surface of the second coating (63). A region of the opposed surface (66) located below the side surface of the front step (64) in FIG. 5 (i.e., the surface of the second coating (63)) forms a front portion (67); a region thereof between the side surface of the front step (64) and the side surface of the back step (65) (i.e., an exposed portion of the surface of the first coating (62)) forms an intermediate portion (68); and a region thereof located above the side surface of the back step (65) in FIG. 5 (i.e., an exposed portion of the surface of the main body (61)) forms a back portion (69).

The front portion (67) of the opposed surface (66) of the valve body (60) is raised above the intermediate portion (68), and the intermediate portion (68) is raised above the back portion (69). The front and back portions (67, 69) of the opposed surface (66) of the valve body (60) have equal widths when viewed in cross section in FIG. 5. In other words, the distance from the lower end of the opposed surface (66) of the valve body (60) illustrated in FIG. 5 to the side surface of the front step (64) is equal to that from the upper end of the opposed surface (66) to the side surface of the back step (65).

Figure 6:
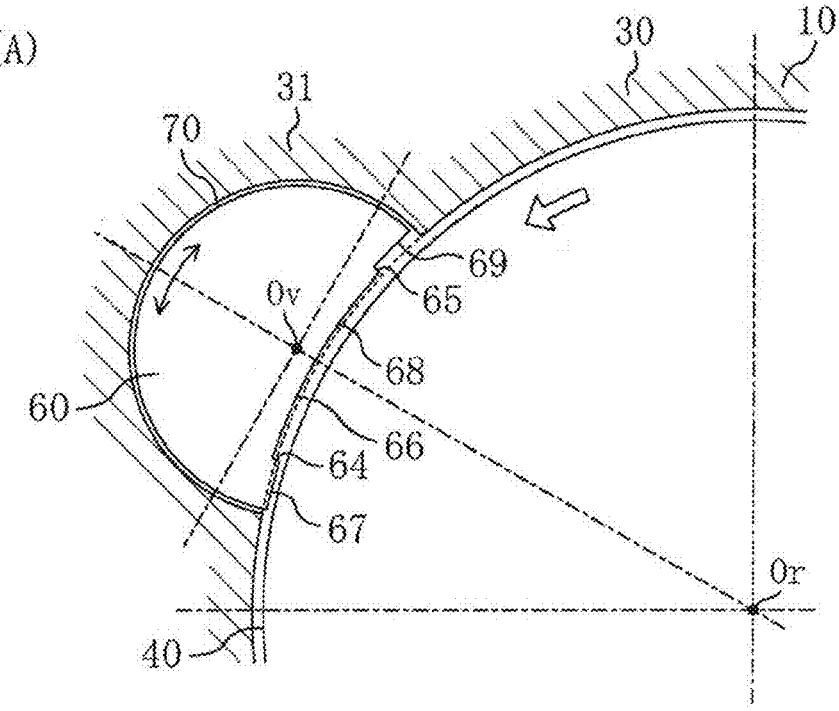
Figure 6:
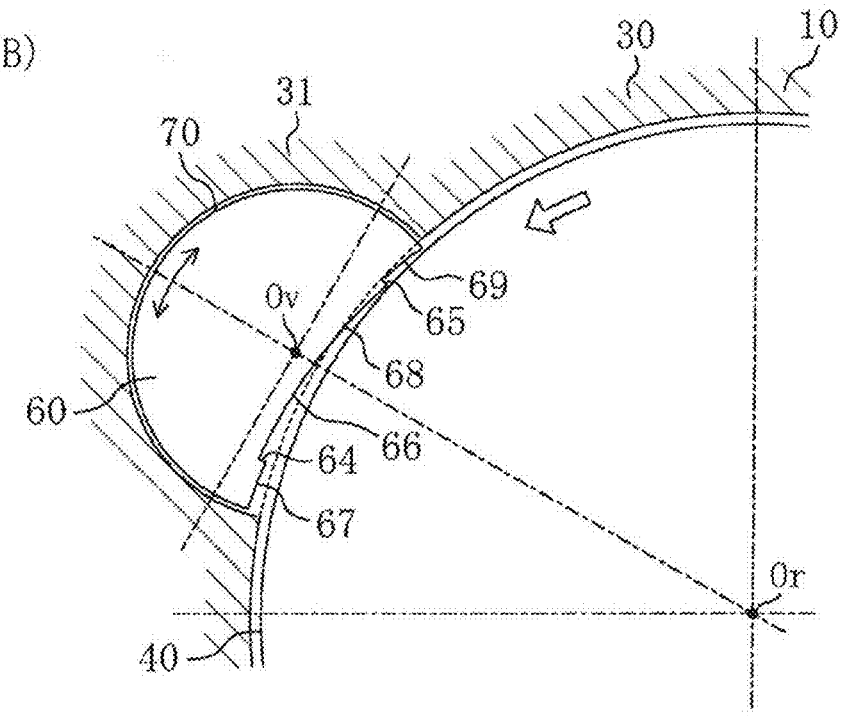

As illustrated in FIG. 6, the slide valve (70) is inserted into the slide valve container (31) of the casing (10) in a position where the front portion (67) of the opposed surface (66) of the valve body (60) is located forward in the direction of rotation of the screw rotor (40) (the counterclockwise direction in FIG. 6). As described above, the back surface of the valve body (60) (i.e., the surface of the valve body (60) opposite to the opposed surface (66)) forms a cylindrical surface. The front step (64) is located forward of the plane containing the axis Ov through the center of curvature of the back surface of the valve body (60) and the rotation axis Or of the screw rotor (40) in the direction of rotation of the screw rotor (40). The back step (65) is located backward of the above plane in the direction of rotation of the screw rotor (40).

The curvature radius of the front portion (67) of the opposed surface (66) of the valve body (60) is slightly smaller than that of the inner circumferential surface of the cylindrical wall (30). The curvature radii of the intermediate portion (68) and the back portion (69) of the opposed surface (66) of the valve body (60) are slightly larger than the curvature radius of the inner circumferential surface of the cylindrical wall (30). Furthermore, the curvature radius of the back portion (69) is slightly larger than that of the intermediate portion (68).

While the curvature centers of the front portion (67), the intermediate portion (68), and the back portion (69) coincide with the curvature center of the inner circumferential surface of the cylindrical wall (30) (i.e., the rotation axis Or of the screw rotor (40)), the front portion (67) is located inward of the inner circumferential surface of the cylindrical wall (30) (i.e., toward the screw rotor (40)); and the intermediate portion (68) and the back portion (69) are located outward of the inner circumferential surface of the cylindrical wall (30) (i.e., in the direction opposite to the screw rotor (40)). In other words, in this state, the clearance between the front portion (67) and the screw rotor (40) is narrower than the clearance between the cylindrical wall (30) and the screw rotor (40), and the clearance between each of the intermediate portion (68) and the back portion (69) and the screw rotor (40) is wider than the clearance between the cylindrical wall (30) and the screw rotor (40).

—Operational Behavior—

Figure 7:
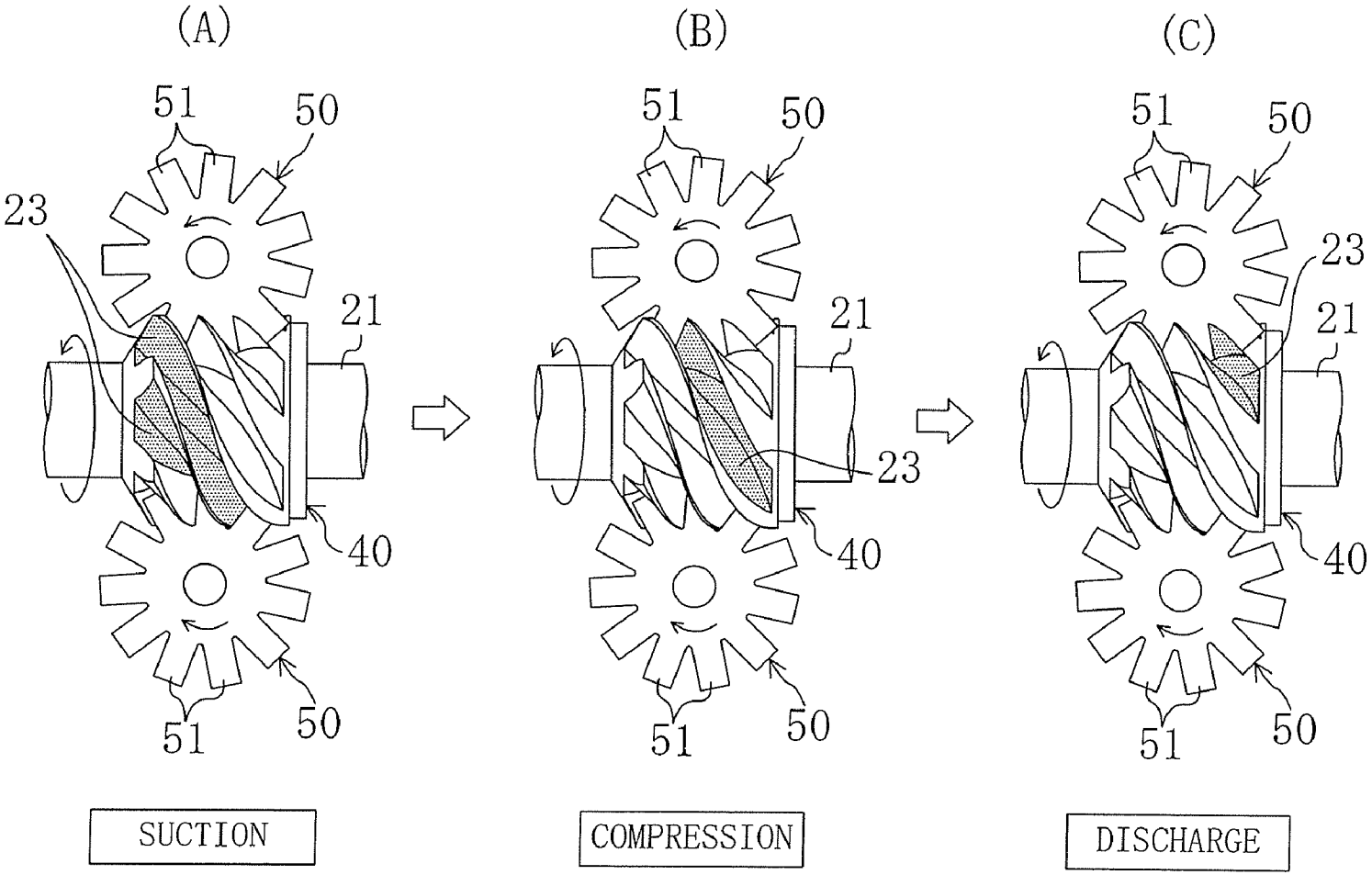

The overall operational behavior of the screw compressor (1) will be described with reference to FIG. 7.

When the electric motor of the screw compressor (1) is started, the screw rotor (40) rotates with rotation of the drive shaft (21). The gate rotors (50) also rotate with the rotation of the screw rotor (40). The compression mechanism (20) repeats suction, compression, and discharge phases. The compression chambers (23) which are dotted in FIG. 7 will be described hereinafter.

In FIG. 7(A), the dotted compression chambers (23) communicate with the low-pressure space (S1). The helical grooves (41) in which the compression chambers (23) are formed are engaged with the corresponding gates (51) of the lower gate rotor (50) as viewed in FIG. 7(A). With rotation of the screw rotor (40), the gates (51) relatively move toward the ends of the helical grooves (41), and then the capacity of the compression chambers (23) increases with the movement of the gates (51). Consequently, the low-pressure refrigerant gas in the low-pressure space (S1) is sucked into the compression chambers (23) through the suction port (24).

Further rotation of the screw rotor (40) results in the state illustrated in FIG. 7(B). In FIG. 7(B), the dotted compression chamber (23) is in the completely-closed state. In other words, the helical groove (41) in which the compression chamber (23) is formed is engaged with the corresponding gate (51) of the upper gate rotor (50) as viewed in FIG. 7(B), and is separated from the low-pressure space (S1) by the gate (51). When the gate (51) moves toward the end of the helical groove (41) with the rotation of the screw rotor (40), this gradually reduces the volume of the compression chamber (23). Consequently, the refrigerant gas in the compression chamber (23) is compressed.

Still further rotation of the screw rotor (40) results in the state illustrated in FIG. 7(C). In FIG. 7(C), the dotted compression chamber (23) communicates with the high-pressure space (S2) through the discharge port (25). When the gate (51) relatively moves toward the end of the helical groove (41) with the rotation of the screw rotor (40), the compressed refrigerant gas is pushed out of the compression chamber (23) into the high-pressure space (S2).

Capacity control of the compression mechanism (20) using the slide valves (70) will be described with reference to FIG. 1. The capacity of the compression mechanism (20) denotes "the amount of refrigerant discharged from the compression mechanism (20) into the high-pressure space (S2) per unit time."

When the end surface (P2) of each of the slide valves (70) is in intimate contact with the end surface (P1) of the corresponding slide valve container (31) (i.e., when the slide valve (70) is pushed to the limit of movement of the slide valve (70) and reaches the limit), the capacity of the compression mechanism (20) is maximum. In other words, in this state, the bypass path (33) is completely blocked by the valve body (60) of the slide valve (70). The refrigerant gas sucked from the low-pressure space (S1) into the compression chamber (23) is entirely discharged into the high-pressure space (S2).

In contrast, when the end surface (P2) of the slide valve (70) is away from the end surface (P1) of the slide valve container (31) (i.e., when the slide valve (70) is moved back to the right as viewed in FIG. 1), the opening of the bypass path (33) is formed in the inner circumferential surface of the cylindrical wall (30). In this state, the refrigerant gas sucked from the low-pressure space (S1) into the compression chamber (23) is partially returned through the compression chamber (23) and the bypass path (33) into the low-pressure space (S1) during the compression phase, and the remaining part of the refrigerant gas is compressed to the end and then discharged into the high-pressure space (S2). As the interval between the end surface (P2) of the slide valve (70) and the end surface (P1) of the slide valve container (31) increases, the amount of the refrigerant returned through the bypass path (33) into the low-pressure space (S1) increases while the amount of the refrigerant discharged into the high-pressure space (S2) decreases. This decrease means that the capacity of the compression mechanism (20) decreases.

The refrigerant discharged from the compression chamber (23) into the high-pressure space (S2) initially flows into the discharge port (25) formed in the slide valve (70). Thereafter, the refrigerant flows into the high-pressure space (S2) through the path formed to the back of the guide portion (75) of the slide valve (70).

The operation of the steps (64, 65) of the slide valve (70) will be described with reference to FIG. 6.

As described above, the sliding surface (76) of the guide portion (75) of each of the slide valves (70) is in slidable contact with the outer circumferential surface of the bearing holder (35). The slidable contact between the guide portion (75) and the outer circumferential surface of the bearing holder (35) limits movement of the slide valve (70) attempting to rotate about the axis of the slide valve (70).

However, during operation of the screw compressor (1), various gas pressures act on the slide valve (70). For example, the pressure of high-pressure gas in the high-pressure space (S2) acts on the guide portion (75); the pressure of low-pressure gas in the low-pressure space (S1) acts on the end surface (P2) and back surface of the valve body (60); and the pressure of gas in the compression chamber (23) acts on the opposed surface (66) of the valve body (60). For this reason, during operation of the screw compressor (1), the slide valve (70) may be elastically deformed under the gas pressures, and the valve body (60) may slightly rotate about the axis Ov of the valve body (60) as illustrated by the arrow in FIG. 6. Since the clearance between the opposed surface (66) of the valve body (60) and the screw rotor (40) is extremely narrow, even slight rotation of the valve body (60) may cause contact between the valve body (60) and the screw rotor (40). In FIG. 6, the illustrated clearance between the opposed surface (66) of the valve body (60) and the screw rotor (40) is exaggerated.

To address the above problem, the opposed surface (66) of the valve body (60) of the slide valve (70) of this embodiment includes the steps (64, 65) configured such that portions of the opposed surface (66) located forward of the side surfaces of the steps (64, 65) in the direction of rotation of the screw rotor (40) are raised. The opposed surface (66) of the valve body (60) is in contact with the refrigerant gas in the compression chamber (23). The screw rotor (40) defining the compression chamber (23) rotates counterclockwise in FIG. 6. Therefore, the refrigerant gas in the compression chamber (23) is blown toward the steps (64, 65) of the valve body (60), and thus, the kinetic energy of the refrigerant gas which has struck the side surfaces of the steps (64, 65) is converted into pressure. In other words, dynamic pressures are generated on the steps (64, 65) using the refrigerant gas. The dynamic pressures generated on the steps (64, 65) act on the valve body (60). This prevents contact between the valve body (60) and the screw rotor (40).

For example, when the action of the gas pressures on the slide valve (70) allows the valve body (60) to slightly rotate counterclockwise in FIG. 6(A), the front portion (67) of the opposed surface (66) moves closer to the screw rotor (40). To address this problem, the opposed surface (66) of the valve body (60) includes the front step (64) configured such that a portion of the opposed surface (66) located forward of the side surface of the front step (64) in the direction of rotation of the screw rotor (40) is raised. A dynamic pressure is generated on the front step (64). The front step (64) is located forward of the axis Ov of the valve body (60) in the direction of rotation of the screw rotor (40). Therefore, when the dynamic pressure generated on the front step (64) acts on the valve body (60), this produces a moment causing rotation of the valve body (60) in the clockwise direction in FIG. 6(A). Consequently, the valve body (60) attempting to rotate counterclockwise in FIG. 6(A) is pushed back in the clockwise direction in FIG. 6(A) by the dynamic pressure generated on the front step (64). Thus, the interval between the valve body (60) and the screw rotor (40) is maintained.

When the dynamic pressure generated on the front step (64) is too high, the clockwise rotation angle of the valve body (60) becomes too large, and thus, as illustrated in FIG. 6(B), the back portion (69) of the opposed surface (66) may move too close to the screw rotor (40). To address this problem, the opposed surface (66) of the valve body (60) includes the back step (65) configured such that a portion of the opposed surface (66) located forward of the side surface of the back step (65) in the direction of rotation of the screw rotor (40) is raised. A dynamic pressure is generated on the back step (65). The back step (65) is located backward of the axis Ov of the valve body (60) in the direction of rotation of the screw rotor (40). Therefore, when the dynamic pressure generated on the back step (65) acts on the valve body (60), this produces a moment causing rotation of the valve body (60) in the counterclockwise direction in FIG. 6(B). Consequently, the valve body (60) attempting to rotate clockwise in FIG. 6(B) is pushed back in the counterclockwise direction in FIG. 6(B) by the dynamic pressure generated on the back step (65). Thus, the interval between the valve body (60) and the screw rotor (40) is maintained.

—Advantages of the Embodiment—

The opposed surface (66) of the slide valve (70) of this embodiment includes the steps (64, 65) serving as dynamic pressure generators, and the steps (64, 65) generate dynamic pressures by using refrigerant gas flowing in the compression chamber (23) while being in contact with the opposed surface (66). The slide valve (70) is maintained without being in contact with the screw rotor (40) by the dynamic pressures generated on the steps (64, 65). In view of the above, even if, for example, deformation of the slide valve (70) during operation of the screw compressor (1) causes the slide valve (70) to move closer to the screw rotor (40), the slide valve (70) is maintained without being in contact with the screw rotor (40) because the dynamic pressures generated on the steps (64, 65) act on the slide valve (70).

Thus, according to this embodiment, even when such a wide gap is not provided between the slide valve (70) and the screw rotor (40), contact between the slide valve (70) and the screw rotor (40) during operation of the screw compressor (1) can be avoided. This can increase both the reliability and efficiency of the screw compressor (1).

The slide valve (70) of this embodiment includes the front step (64) formed on a portion of the opposed surface (66) of the valve body (60), and the portion of the opposed surface (66) is located forward in the direction of rotation of the screw rotor (40). This allows a dynamic pressure to act on a portion of the slide valve (70) tending to be in contact with the screw rotor (40), and can reliably prevent contact between the slide valve (70) and the screw rotor (40).

As described above, the dynamic pressure generated on the front step (64) produces a moment in the direction in which the portion of the slide valve (70) located forward in the direction of rotation of the screw rotor (40) is separated from the screw rotor (40) (the clockwise direction in FIG. 6). For this reason, when the dynamic pressure generated on the front step (64) is too high, a portion of the slide valve (70) located backward in the direction of rotation of the screw rotor (40) may be in contact with the screw rotor (40).

To address this problem, the slide valve (70) of this embodiment includes both the front and back steps (64, 65) serving as dynamic pressure generators. The dynamic pressure generated on the back step (65) produces a moment in the direction in which the portion of the slide valve (70) located backward in the direction of rotation of the screw rotor (40) is separated from the screw rotor (40) (the counterclockwise direction in FIG. 6). In view of the above, according to this embodiment, the balance achieved between the dynamic pressure generated on the front step (64) and the dynamic pressure generated on the back step (65) can maintain the slide valve (70) while the slide valve (70) is not in contact with the screw rotor (40).

In the slide valve (70) of this embodiment, the front portion (67) of the opposed surface (66) of the valve body (60) protrudes inwardly beyond the inner circumferential surface of the cylindrical wall (30). This can reduce the clearance between the front portion (67) of the opposed surface (66) of the valve body (60) and the screw rotor (40) by utilizing the front step (64) for generating a dynamic pressure. This can improve the hermeticity of the clearance between the front portion (67) of the opposed surface (66) and the screw rotor (40). In view of the above, according to this embodiment, while contact between the slide valve (70) and the screw rotor (40) can be avoided by utilizing the dynamic pressure generated on the front step (64), the efficiency of the screw compressor (1) can be improved by reducing the amount of refrigerant leaking out of the compression chamber (23) through the clearance between the slide valve (70) and the screw rotor (40).

—First Variation of the Embodiment—

The valve body (60) of the slide valve (70) of the embodiment includes the steps (64, 65) having equal heights (of approximately 5 pm). However, the steps (64, 65) may have different heights. For example, when the moment causing rotation of the valve body (60) in the clockwise direction in FIG. 6 should be greater than the moment causing rotation of the valve body (60) in the counterclockwise direction in FIG. 6, the front step (64) may be higher than the back step (65).

The distances from the axis Ov of the valve body (60) of the slide valve (70) of this embodiment to the steps (64, 65) are equal to each other. However, the distance from the axis Ov of the valve body (60) to the front step (64) may be different from the distance therefrom to the back step (65). For example, when the moment causing rotation of the valve body (60) in the clockwise direction in FIG. 6 should be greater than the moment causing rotation of the valve body (60) in the counterclockwise direction in FIG. 6, the distance from the axis Ov of the valve body (60) to the front step (64) may be greater than the distance therefrom to the back step (65).

As described above, for example, the heights of the steps (64, 65) of the valve body (60) of the slide valve (70) and the distances from the axis Ov of the valve body (60) to the steps (64, 65) are appropriately determined according to, e.g., the magnitude and direction of the moment which should act on the valve body (60) in order to maintain the valve body (60) while preventing the valve body (60) from being in contact with the screw rotor (40). The valve body (60) may include only the front step (64). This configuration can prevent contact between the valve body (60) and the screw rotor (40).

—Second Variation of the Embodiment—

The resin coatings (62, 63) are formed on the opposed surface (66) of the valve body (60) of the slide valve (70) of this embodiment, thereby forming the steps (64, 65). However, the steps (64, 65) may be formed on the valve body (60) by using any other techniques. The steps (64, 65) may be foamed on the valve body (60) by, e.g., machining, such as cutting or grinding, of the opposed surface (66) of the valve body (60).

The foregoing embodiment has been set forth merely for purposes of preferred examples in nature, and is not intended to limit the scope, applications, and use of the invention.

Industrial Applicability

As described above, the present invention is useful for single screw compressors.

What is claimed is:

1. A screw compressor comprising:

a casing having a cylinder portion with an inner circumferential surface;

a screw rotor rotatable about a rotor axis and being disposed in the cylinder portion to define a compression chamber with the inner circumferential surface such that fluid sucked into the compression chamber is compressed by rotation of the screw rotor; and a capacity control slide valve axially slideable along a valve axis parallel to the rotor axis and opposed to an outer circumferential surface of the screw rotor, the capacity control slide valve having a valve body with a back surface and a curved surface, the curved surface extending substantially along a curvature of the inner circumferential surface directly opposing the outer circumferential surface of the screw rotor, with a dynamic pressure generator being formed on the curved surface, and the dynamic pressure generator being configured such that the fluid in contact with a structure of the curved surface of the capacity control slide valve forms a dynamic pressure, and the dynamic pressure acts on the capacity control slide valve such that contact between the valve body and screw rotor caused by rotation of the valve body about the valve axis is avoided.

2. The screw compressor of claim 1, wherein the curved surface of the capacity control slide valve includes a front step serving as part of the dynamic pressure generator, the front step being formed on part of the curved surface, located forward in a direction of rotation of the screw rotor, and configured such that a front portion of the curved surface located forward of a side surface of the front step in the direction of rotation of the screw rotor is raised.

3. The screw compressor of claim 2, wherein the front portion of the curved surface located forward of the side surface of the front step is closer to the screw rotor than the inner circumferential surface of the cylinder portion.

4. The screw compressor of claim 2, wherein the curved surface of the capacity control slide valve includes a back step serving as part of the dynamic pressure generator, the back step being formed on part of the curved surface located backward in the direction of rotation of the screw rotor, and configured such that an intermediate portion of the curved surface located forward of a side surface of the back step in the direction of rotation of the screw rotor is raised.

5. The screw compressor of claim 4, wherein a back portion of the curved surface located backward of the side surface of the back step in the direction of rotation of the screw rotor is farther from the screw rotor than the inner circumferential surface of the cylinder portion.

6. The screw compressor of claim 3, wherein the curved surface of the capacity control slide valve includes a back step serving as part of the dynamic pressure generator, the back step being formed on part of the curved surface located backward in the direction of rotation of the screw rotor, and configured such that an intermediate portion of the curved surface located forward of a side surface of the back step in the direction of rotation of the screw rotor is raised.

7. The screw compressor of claim 6, wherein a back portion of the opposed surface located backward of the side surface of the back step in the direction of rotation of the screw rotor is farther from the screw rotor than the inner circumferential surface of the cylinder portion.

* * * * *